US012650272B2

(12) United States Patent
Kurosawa et al.

(10) Patent No.: US 12,650,272 B2
(45) Date of Patent: Jun. 9, 2026

(54) HEAT EXCHANGER AND METHOD FOR MANUFACTURING THE SAME

(71) Applicant: HONDA MOTOR CO., LTD., Tokyo (JP)

(72) Inventors: Yuta Kurosawa, Saitama (JP); Tsuneo Endo, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 113 days.

(21) Appl. No.: 18/615,541

(22) Filed: Mar. 25, 2024

(65) Prior Publication Data

US 2024/0328728 A1 Oct. 3, 2024

(30) Foreign Application Priority Data

Mar. 29, 2023 (JP) ..... 2023-053285

(51) Int. Cl.
*F28F 3/12* (2006.01)

(52) U.S. Cl.
CPC ..... *F28F 3/12* (2013.01)

(58) Field of Classification Search
CPC ..... F28F 3/12
See application file for complete search history.

(56) References Cited

U.S. PATENT DOCUMENTS 1,056,373 A * 3/1913 Segelken ..... F22B 7/20 165/177
3,185,143 A * 5/1965 Wilson, Sr. ..... F24C 1/00 126/91 A
4,044,796 A * 8/1977 Smick ..... F22B 37/06 366/144
4,336,838 A * 6/1982 Ely ..... F28F 13/12 165/146
4,412,558 A * 11/1983 Burke ..... F28F 13/12 122/155.2
4,502,509 A * 3/1985 Spitz ..... F15D 1/0015 138/37
4,577,681 A * 3/1986 Hughes ..... F23M 9/00 165/174
4,727,907 A * 3/1988 Duncan ..... F28F 13/12 165/174

(Continued)

FOREIGN PATENT DOCUMENTS

JP 2021-188872 A 12/2021

*Primary Examiner* — Gordon A Jones
(74) *Attorney, Agent, or Firm* — Paratus Law Group, PLLC

(57) ABSTRACT

A heat exchanger includes: a core portion; a first refrigerant flow path; and a second refrigerant flow path as defined herein, the first refrigerant flow path includes a first main flow path extending in a first direction, the second refrigerant flow path includes a second main flow path extending in the first direction, the first main flow path and the second main flow path are defined by a partition wall extending in the first direction in the core portion, the second fluid flows through the second main flow path from one side to other side in the first direction, and in the second main flow path, a plurality of fins extending from the partition wall toward a center of the second main flow path when viewed from the first direction are spirally provided with the first direction as an axis at predetermined intervals in the first direction.

7 Claims, 11 Drawing Sheets

(56) References Cited

U.S. PATENT DOCUMENTS

| | | | | | |
|---|---|---|---|---|---|
| 4,850,336 | A * | 7/1989 | Hagan | F23M 9/003 | 126/307 R |
| 5,492,408 | A * | 2/1996 | Alfare | B01F 25/43151 | 366/337 |
| 5,522,661 | A * | 6/1996 | Tsukada | B01F 25/43151 | 366/337 |
| 5,605,400 | A * | 2/1997 | Kojima | B01D 53/504 | 366/339 |
| 5,813,762 | A * | 9/1998 | Fleischli | B01F 25/43161 | 366/337 |
| 7,013,843 | B1 * | 3/2006 | Weintraub | F28F 1/325 | 122/367.3 |
| 11,802,742 | B2 * | 10/2023 | Fujiwara | B33Y 80/00 | |
| 2007/0000651 | A1 * | 1/2007 | Guo | F28F 1/426 | 165/181 |
| 2017/0205146 | A1 * | 7/2017 | Turney | F28F 1/025 | |
| 2021/0003349 | A1 * | 1/2021 | Horoszczak | F28F 1/006 | |
| 2021/0381473 | A1 * | 12/2021 | Endou | F28F 1/025 | |

* cited by examiner

HEAT EXCHANGER AND METHOD FOR MANUFACTURING THE SAME

CROSS-REFERENCE TO RELATED APPLICATION

This application is based on and claims priority under 35 USC 119 from Japanese Patent Application No. 2023-053285 filed on Mar. 29, 2023.

TECHNICAL FIELD

The present invention relates to a heat exchanger and a method for manufacturing the same.

BACKGROUND ART

Heat exchangers using various heat transfer methods have been widely used as devices for transferring heat between two fluids having different temperatures.

In recent years, researches and developments have been actively conducted that contribute to improvement in energy efficiency in order to allow more people to access affordable, reliable, sustainable and advanced energy. In a heat exchanger, improvement in heat exchange efficiency is required in order to contribute to improvement in energy efficiency.

Further, recently, a technique related to an additive manufacturing method of forming a shape by additive manufacturing a material has progressed, and by using the additive manufacturing method, it is possible to manufacture a product having a complicated three-dimensional shape which is difficult to form using conventional cutting, forging, punching, and the like. Also for the heat exchanger, it is possible to manufacture a heat exchanger having a complicated three-dimensional shape by manufacturing using the additive manufacturing method. JP2021-188872A describes a heat exchanger that is not only lightweight and cost-reduced but also has a new function by being manufactured using an additive manufacturing method.

SUMMARY OF INVENTION

However, in the heat exchanger described in JP2021-188872A, in a first refrigerant flow path through which exhaust gas as a first fluid flows, a first refrigerant that continues to flow in the vicinity of a center of the first refrigerant flow path when viewed from a flow direction of the first fluid is generated, and thus there is room for improvement in heat exchange efficiency.

The present invention provides a heat exchanger with improved heat exchange efficiency and a method for manufacturing the same.

The present invention relates to a heat exchanger, including:

a core portion;

a first refrigerant flow path provided in the core portion and configured to allow a first fluid to flow therethrough; and a second refrigerant flow path provided in the core portion and configured to allow a second fluid to flow therethrough, in which in the core portion, the first fluid flowing through the first refrigerant flow path and the second fluid flowing through the second refrigerant flow path exchange heat, the first refrigerant flow path includes a first main flow path extending in a first direction, the second refrigerant flow path includes a second main flow path extending in the first direction, the first main flow path and the second main flow path are defined by a partition wall extending in the first direction in the core portion, the second fluid flows through the second main flow path from one side to the other side in the first direction, and in the second main flow path, a plurality of fins extending from the partition wall toward a center of the second main flow path when viewed from the first direction are spirally provided with the first direction as an axis at predetermined intervals in the first direction.

In addition, the present invention relates to a method for manufacturing the above heat exchanger, the method including:

integrally forming the core portion including the first refrigerant flow path and the second refrigerant flow path that is provided with the fins by additive manufacturing a material.

According to the present invention, since the second fluid flowing through the second main flow path is stirred by the plurality of fins provided in the second main flow path, heat exchange efficiency between the first fluid flowing through the first main flow path and the second fluid flowing through the second main flow path via the partition wall is improved.

DETAILED DESCRIPTION OF THE INVENTION

Figure 1:
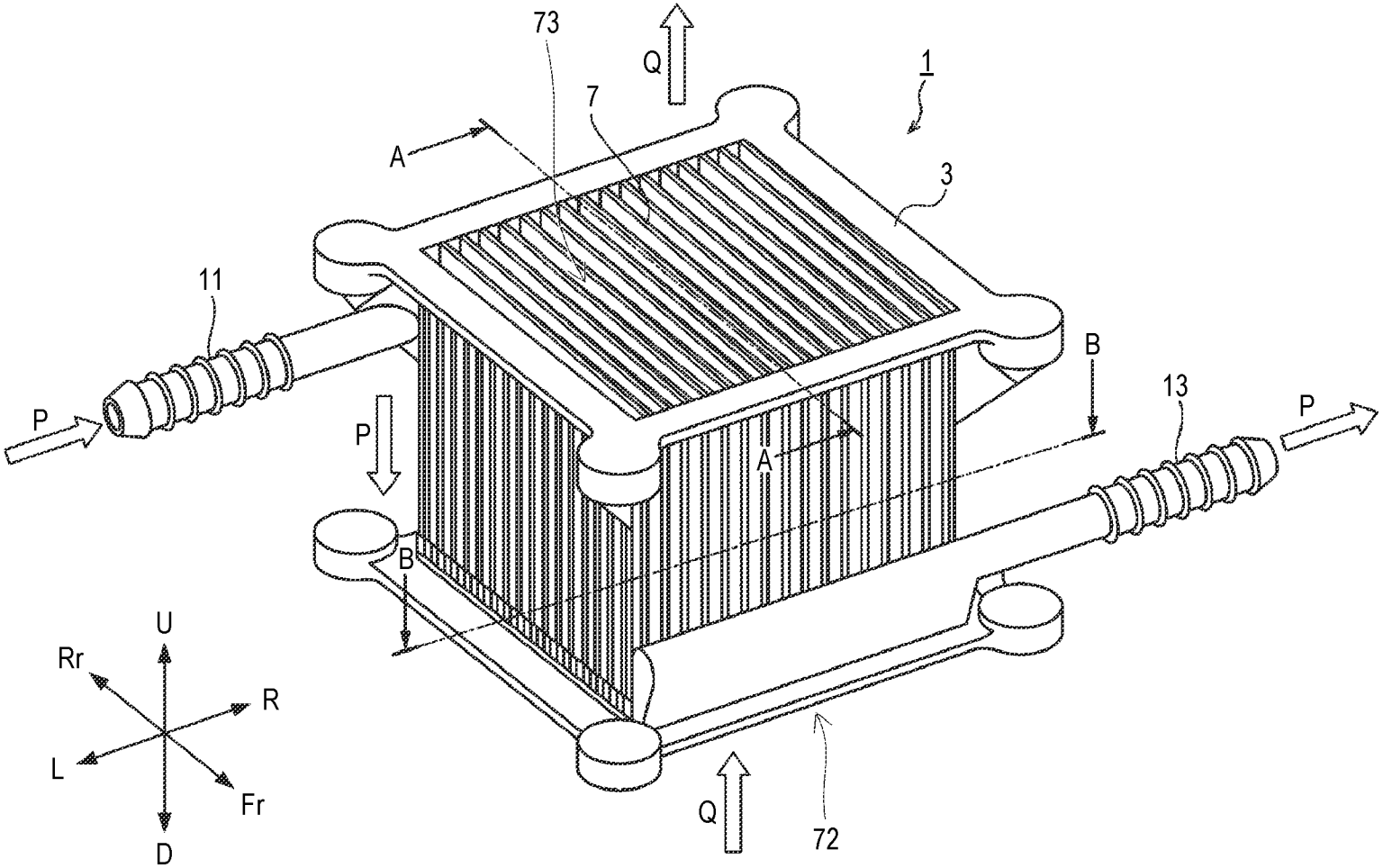
FIG. 1 is a perspective view of a radiator 1.

Hereinafter, an embodiment of a heat exchanger according to the present invention will be described with reference to the accompanying drawings. The drawings are viewed in directions of reference numerals. The heat exchanger is a device that allows a first fluid to be cooled and a second fluid that cools the first fluid to exchange heat via a partition wall.

Properties of the first fluid and the second fluid are not particularly limited, and include all combinations such as gases, liquids, and gases and liquids. The first fluid and the second fluid are, for example, water, oil, an organic medium, air, or helium gas. In addition, a device on which the heat exchanger is mounted is not particularly limited, and includes all products such as a vehicle, a general-purpose device, an aircraft, and a home appliance. In the following embodiment, a radiator mounted on a vehicle will be described as an example of the heat exchanger according to the present invention. That is, in the following embodiment, the first fluid is cooling water for cooling a drive source of a vehicle, and the second fluid is air (traveling wind).

Figure 2:
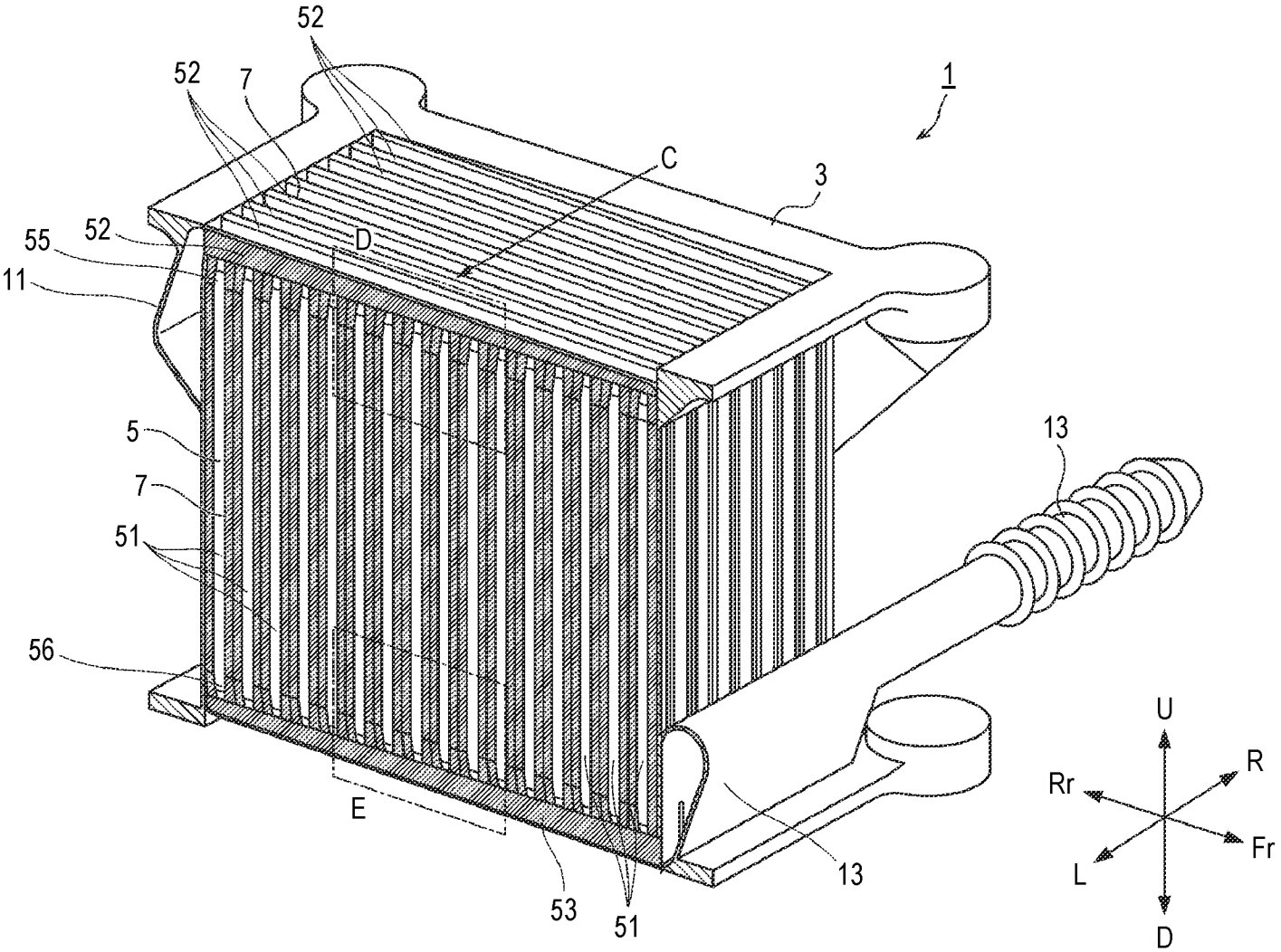
FIG. 2 is a partial perspective view in which a cross section along a line A-A in FIG. 1 is exposed.
Figure 3:
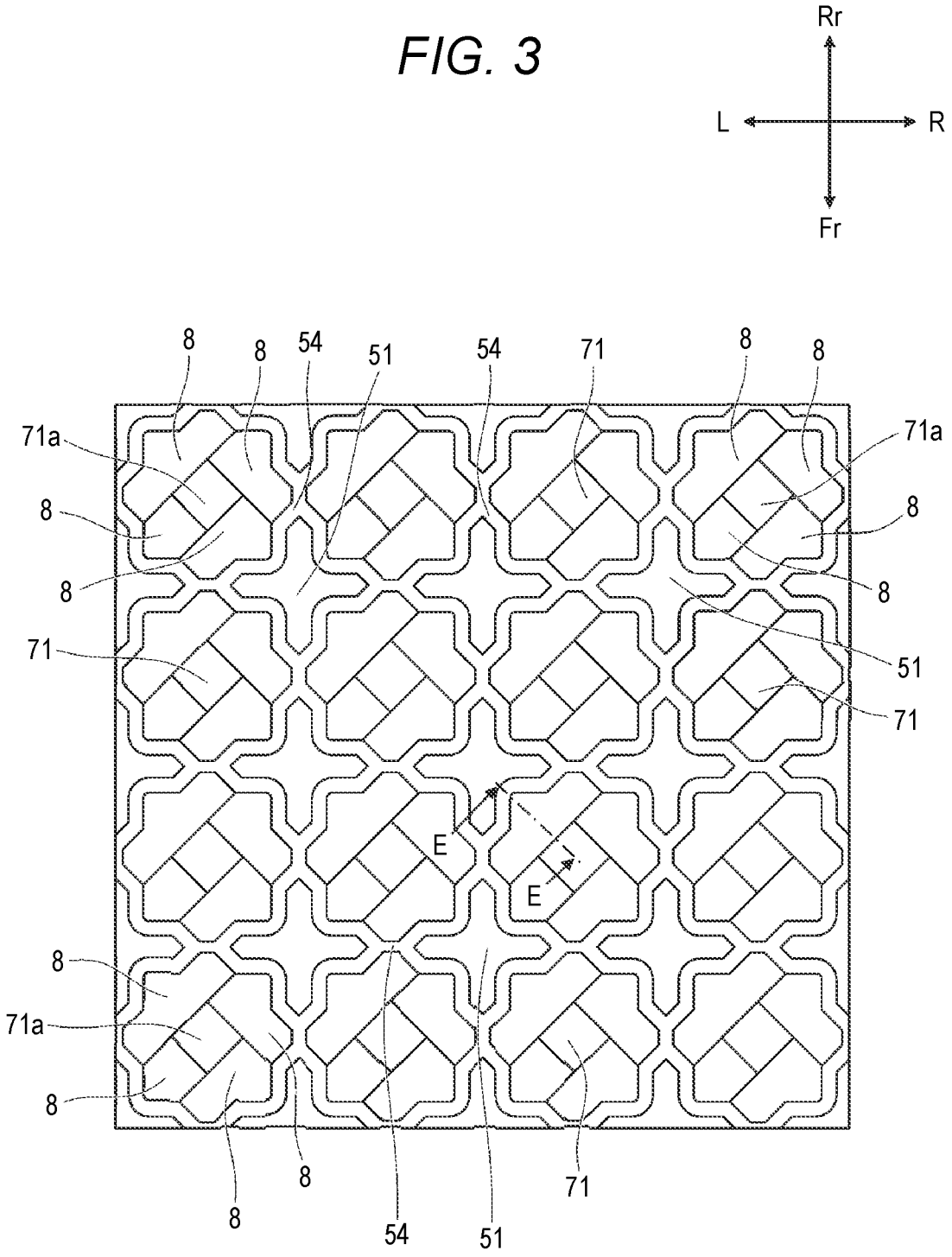
FIG. 3 is a partial cross-sectional view showing a part of a cross section taken along a line B-B in FIG. 1.

FIG. 1 is a perspective view of a radiator 1 according to an embodiment of the present invention. FIG. 2 is a partial perspective view of the radiator 1 of FIG. 1 in which a cross section taken along a line A-A in FIG. 1 is exposed. FIG. 3 is a partial cross-sectional view showing a part of a cross section taken along a line B-B in FIG. 1. In the present specification, in order to simplify and clarify the description, the radiator 1 will be described using an orthogonal coordinate system in three directions, that is, a front-rear direction, a left-right direction, and an upper-lower direction, as shown in FIG. 1. However, it should be noted that the direction is not related to a direction in which the radiator 1 is mounted on a device. In the drawings, an upper side is shown as U, a lower side is shown as D, a left side is shown as L, a right side is shown as R, a front side is shown as Fr, and a rear side is shown as Rr.

The radiator 1 includes a core portion 3, a first refrigerant flow path 5 provided in the core portion 3 and configured to allow cooling water to flow therethrough, and a second refrigerant flow path 7 provided in the core portion 3 and configured to allow air to flow therethrough. In the radiator 1, in the core portion 3, the cooling water flowing through the first refrigerant flow path 5 and the air flowing through the second refrigerant flow path 7 exchange heat via partition walls 54 to be described later. Therefore, there is a difference from a plate type product in which a fluid is separated by a flat plate (heat transfer fins may be added), a fin tube type product in which heat is exchanged via heat conduction using flat plate fins around a circular tube in the conventional art, and the like. In the core portion 3, an introduction pipe 11 is provided on an upper portion of a rear surface, and a discharge pipe 13 is provided on a lower portion of a front surface. The introduction pipe 11 and the discharge pipe 13 communicate with the first refrigerant flow path 5 of the core portion 3.

As indicated by an arrow P, the cooling water is introduced into the core portion 3 from the outside through the introduction pipe 11 provided on the core portion 3, flows from above to below through the first refrigerant flow path 5 in the core portion 3, and then is discharged to the outside through the discharge pipe 13 provided on the core portion 3. On the other hand, as indicated by an arrow Q, the air is introduced into the core portion 3 from a lower surface of the core portion 3, flows from below to above through the second refrigerant flow path 7 in the core portion 3, and then is discharged from an upper surface of the core portion 3. The first refrigerant flow path 5 and the second refrigerant flow path 7 are regularly arranged tubular flow paths. Here, the tubular flow path refers to a pipe-like flow path having a closed cross-sectional shape of a circular arc or a polygon.

As shown in FIG. 2, the first refrigerant flow path 5 includes a plurality of first main flow paths 51 extending in an upper-lower direction and arranged in a front-rear direction, an introduction chamber 52 extending in the front-rear direction and communicating with the plurality of first main flow paths 51 arranged in the front-rear direction, and a discharge chamber 53 extending in the front-rear direction and communicating with the plurality of first main flow paths 51 arranged in the front-rear direction. In the first refrigerant flow path 5, when the plurality of first main flow paths 51 arranged in the front-rear direction and the introduction chamber 52 and the discharge chamber 53 that communicate with the first main flow paths 51 are defined as one set, a plurality of rows of these sets are provided in a left-right direction. Therefore, as shown in FIG. 3, the first main flow paths 51 are regularly arranged in a grid pattern in a cross section viewed from the upper-lower direction.

In the present embodiment shown in FIG. 3, the first main flow path 51 has a cross-shaped flow path cross section in which a space extending in the front-rear direction and a space extending in the left-right direction intersect in a cross shape. A shape of the first main flow path 51 is not limited thereto, and may be any shape such as a square, a rectangle, a diamond, a trapezoid, a circle, an ellipse, a star, a triangle, a polygon of pentagon or more, and other geometric patterns.

The introduction chamber 52 communicates with the introduction pipe 11, and the discharge chamber 53 communicates with the discharge pipe 13.

In the first main flow path 51, as shown in FIG. 2, an introduction side shape changing section 55 having a flow path cross-sectional shape gradually changing toward the introduction chamber 52 and linearly connected to the adjacent first main flow path 51 is provided at an upper end, and a discharge side shape changing section 56 having a flow path cross-sectional shape gradually changing toward the discharge chamber 53 and linearly connected to the adjacent first main flow path 51 is provided at a lower end. The introduction side shape changing section 55 and the discharge side shape changing section 56 will be described later.

As shown in FIG. 3, the second refrigerant flow path 7 includes a plurality of second main flow paths 71 formed by being surrounded by the partition walls 54 that define the first main flow paths 51. The second main flow path 71 extends in the upper-lower direction, is surrounded by the first main flow paths 51 of the first refrigerant flow path 5, and is present in plurality in the front-rear direction and the left-right direction. Therefore, the plurality of second main flow paths 71 are regularly arranged in a grid pattern in the front-rear direction and the left-right direction in the cross section viewed from the upper-lower direction. That is, in the second refrigerant flow path 7, when the plurality of second main flow paths 71 extending in the upper-lower direction and arranged in the front-rear direction are defined as one set, a plurality of rows of these sets are provided in the left-right direction.

In this way, in the core portion 3, the plurality of first main flow paths 51 of the first refrigerant flow path 5 and the plurality of second main flow paths 71 of the second refrigerant flow path 7 are defined by the partition walls 54.

A lower end surface of the core portion 3 is formed with an introduction port 72 for introducing the air into each of the second main flow paths 71 arranged in a grid pattern in the front-rear direction and the left-right direction. An upper end surface of the core portion 3 is formed with a discharge port 73 for discharging the air flowing through each of the second main flow paths 71 arranged in a grid pattern in the front-rear direction and the left-right direction.

The air introduced into the introduction port 72 from below the core portion 3 passes through spaces between a plurality of discharge chambers 53 arranged in the left-right direction, and is introduced into a lower end of the second main flow path 71 of the second refrigerant flow path 7 from below.

The air introduced into the second main flow path 71 of the second refrigerant flow path 7 flows from below to above, passes through spaces between a plurality of introduction chambers 52 arranged in the left-right direction from an upper end of the second main flow path 71, and is discharged above the core portion 3 from the discharge port 73.

Hereinafter, the introduction side shape changing section 55 provided at the upper end of the first main flow path 51 of the first refrigerant flow path 5 will be described in detail with reference to FIGS. 4 to 7. Since the discharge side shape changing section 56 provided at the lower end of the first main flow path 51 of the first refrigerant flow path 5 has the same structure as that of the introduction side shape changing section 55, a detailed description thereof will be omitted.

The introduction side shape changing section 55 of the first main flow path 51 has the flow path cross-sectional shape gradually changing toward the introduction chamber 52 and is linearly connected to the adjacent first main flow path 51.

Figure 4:
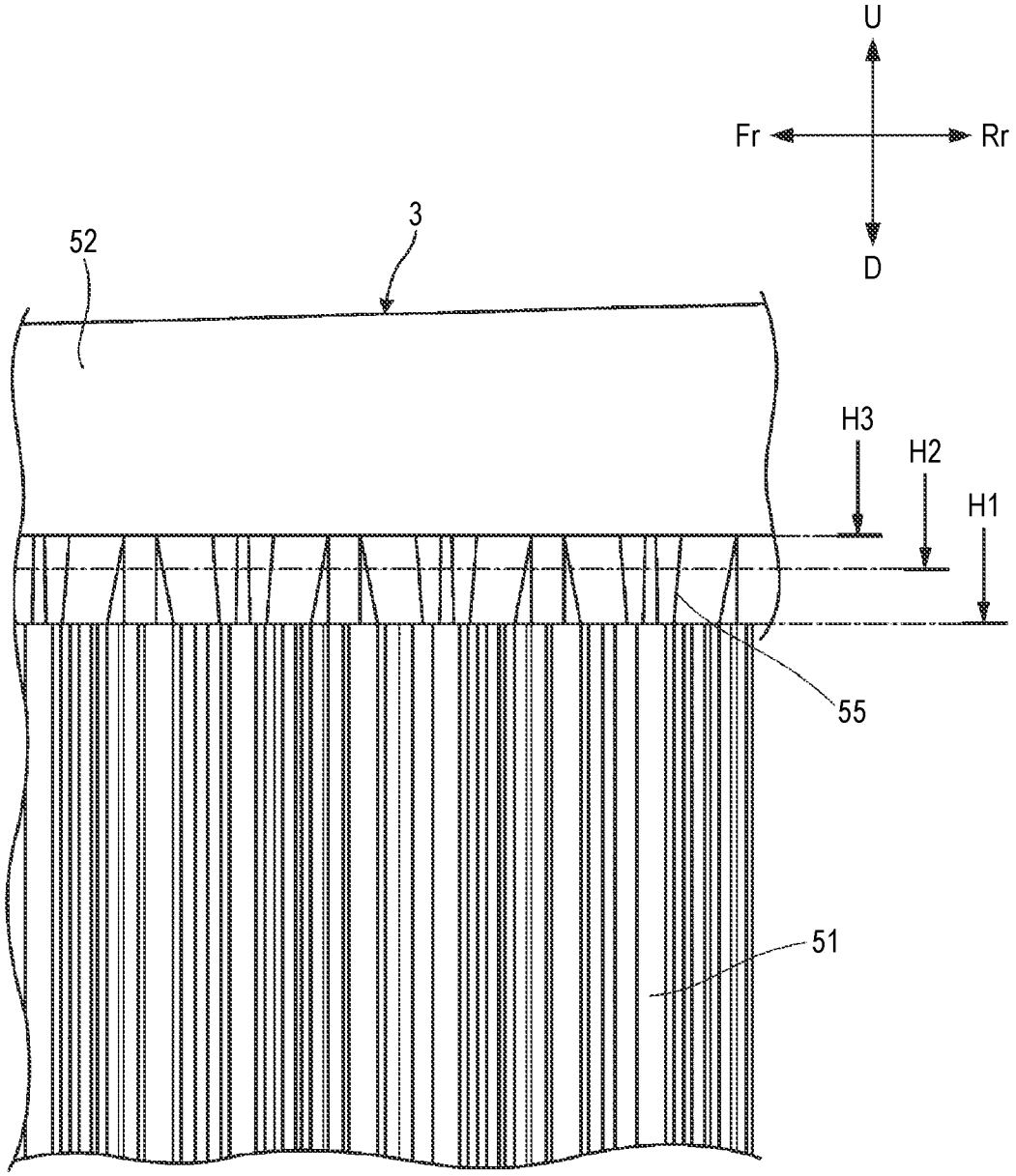
FIG. 4 is a view of a region D in FIG. 2 viewed from a direction C.
Figure 5:
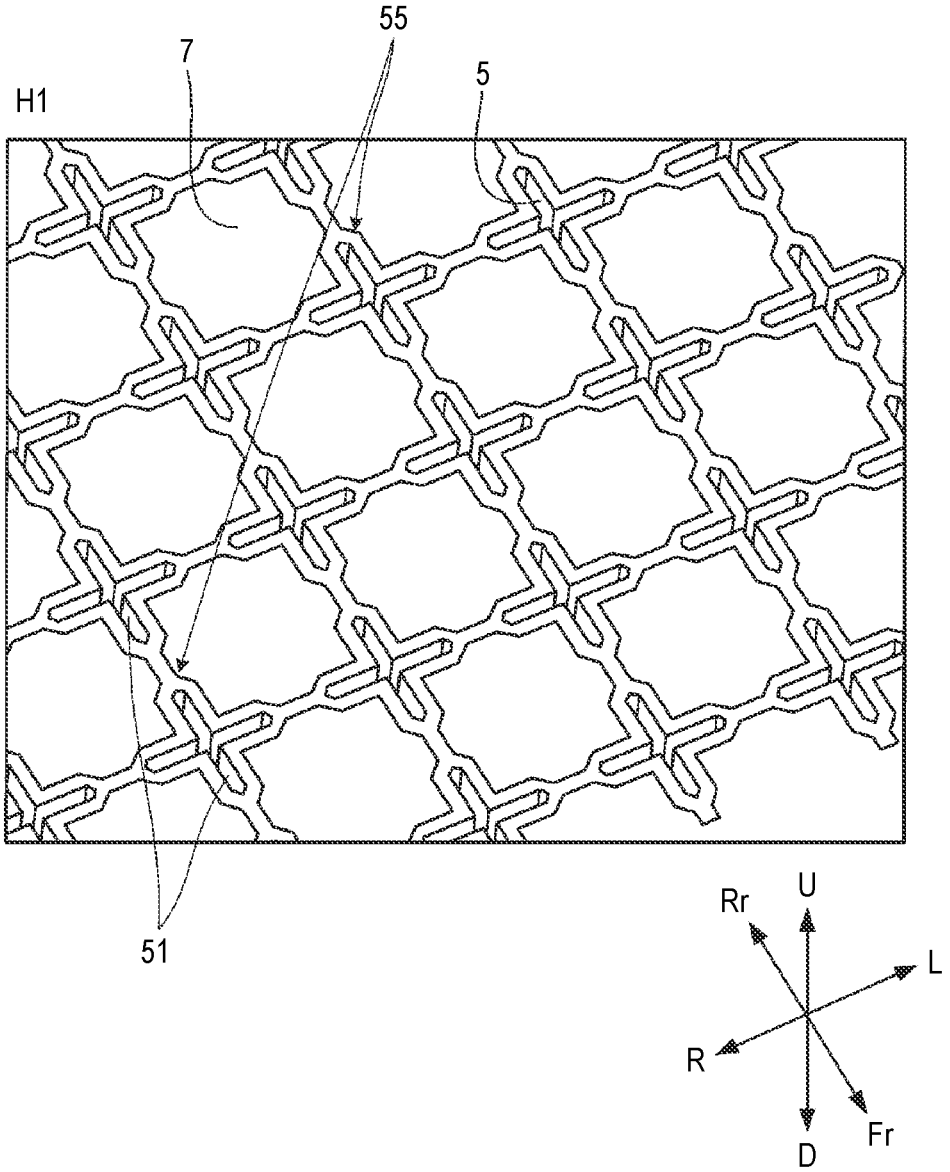
FIG. 5 is a partially enlarged view of a cross-sectional perspective view of the region D in FIG. 4 at an upper-lower direction position H1.
Figure 6:
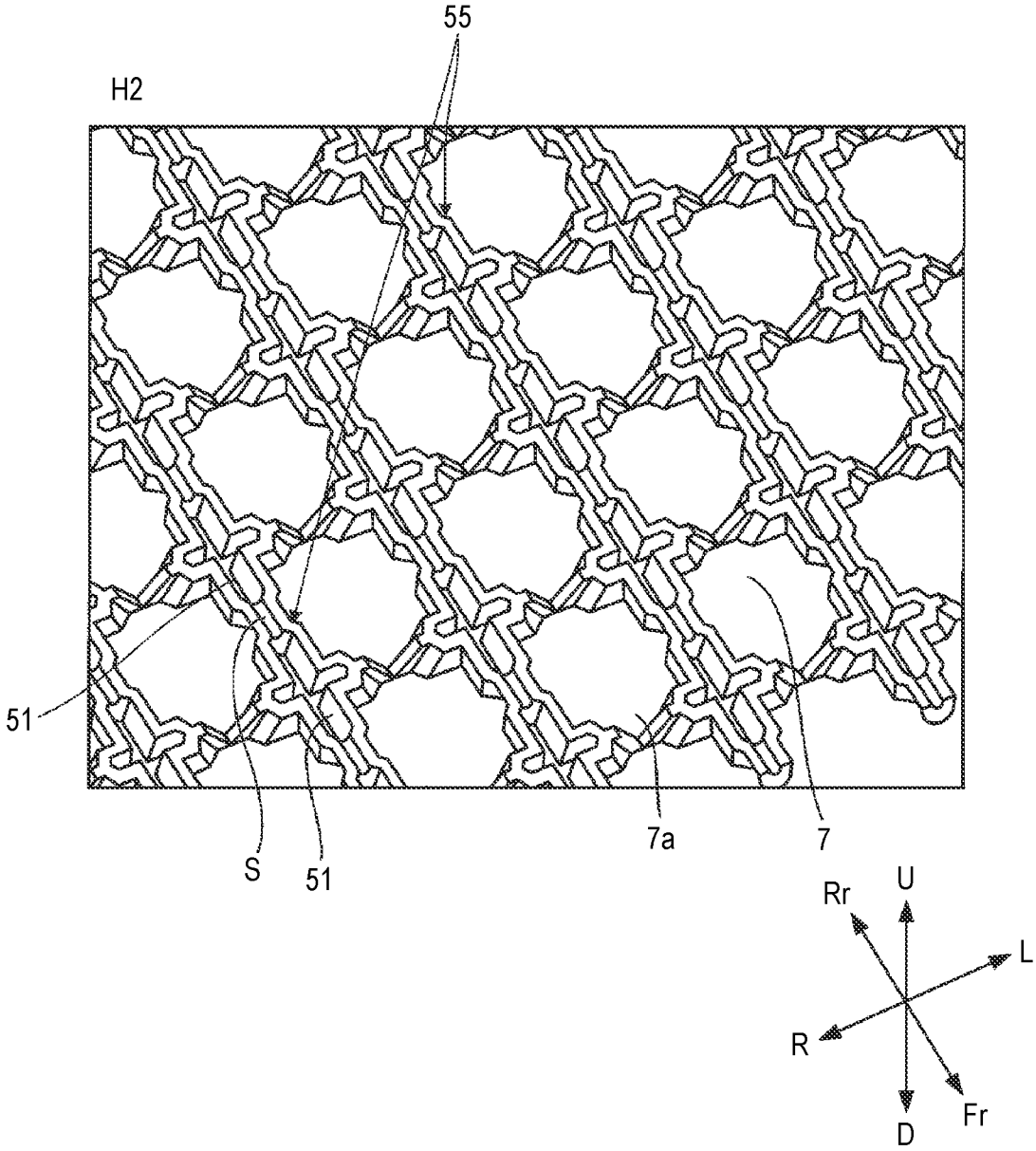
FIG. 6 is a partially enlarged view of a cross-sectional perspective view of the region D in FIG. 4 at an upper-lower direction position H2.
Figure 7:
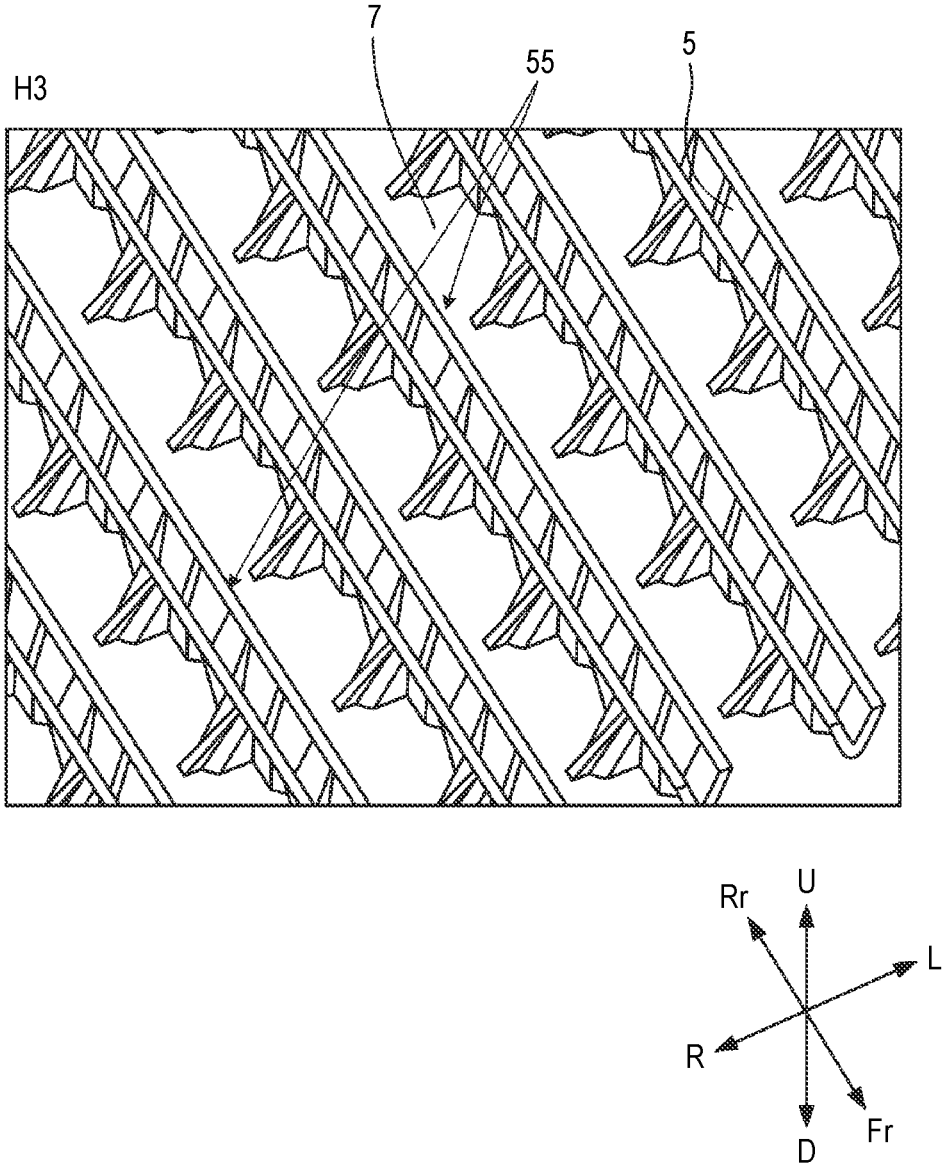
FIG. 7 is a partially enlarged view of a cross-sectional perspective view of the region D in FIG. 4 at an upper-lower direction position H3.
Figure 8:
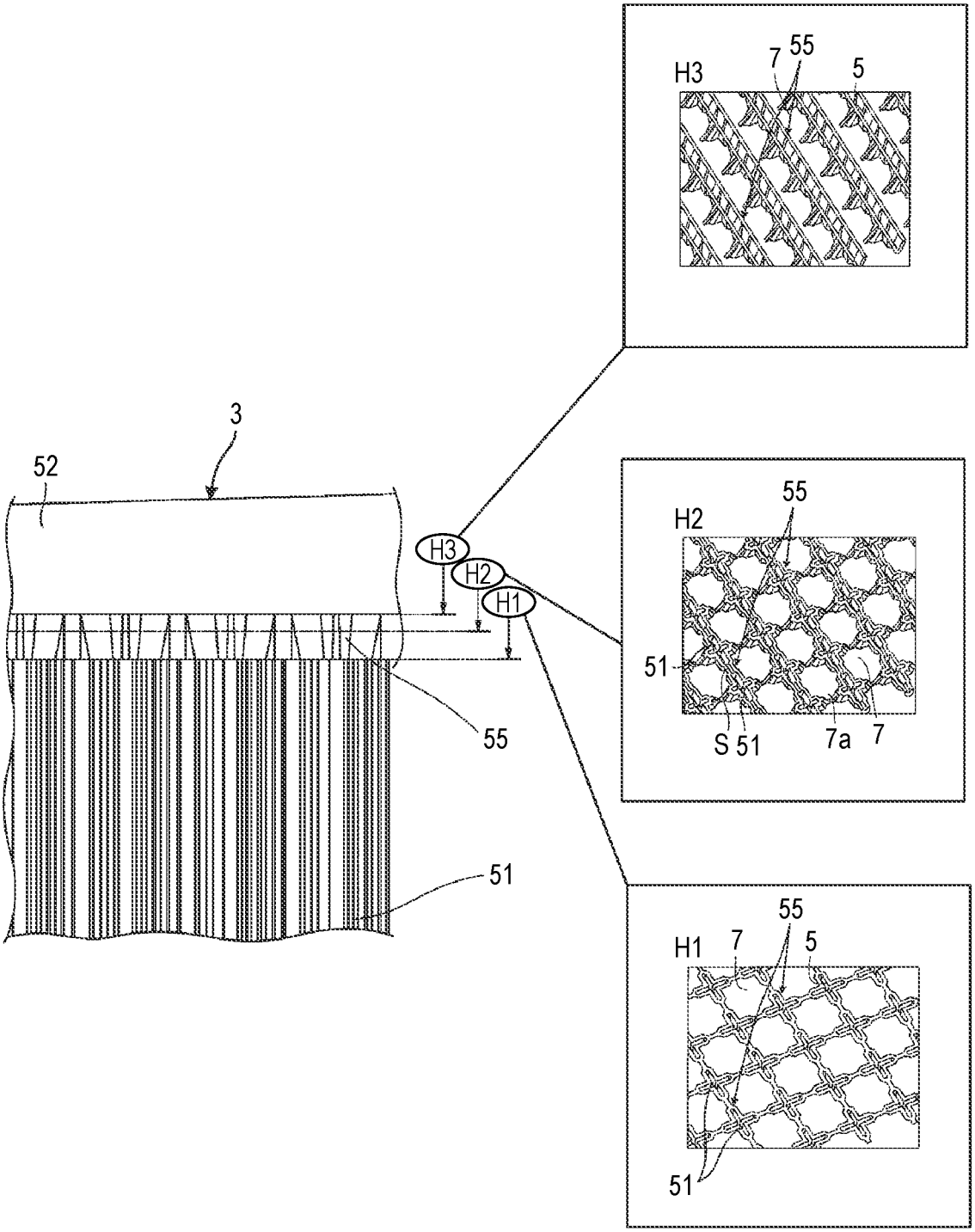
FIG. 8 is a view summarizing the cross-sectional perspective views of the region D in FIG. 4 at the upper-lower direction positions H1, H2, and H3.

FIG. 4 is a view of a region D in FIG. 2 viewed from a direction C. The region D is a region corresponding to upper ends of the first refrigerant flow path 5 and the second refrigerant flow path 7. FIG. 5 shows a partially enlarged view of a cross-sectional perspective view at an upper-lower direction position H1 in FIG. 4. Similarly, FIG. 6 shows a partially enlarged view of a cross-sectional perspective view at an upper-lower direction position H2 in FIG. 4, FIG. 7 shows a partially enlarged view of a cross-sectional perspective view at an upper-lower direction position H3 in FIG. 4, and FIG. 8 is a view summarizing the cross-sectional perspective views of the region D in FIG. 4 at the upper-lower direction positions H1, H2, and H3. In FIGS. 5 to 8, fins 8 to be described later are omitted.

A partially enlarged view H1 shown in FIG. 5 shows an enlarged view at the lowermost upper-lower direction position H1 among the three enlarged views, and shows a start point of the introduction side shape changing section 55. At the upper-lower direction position H1, the first refrigerant flow path 5 has a shape shown in FIG. 3. That is, the first main flow path 51 of the first refrigerant flow path 5 has a cross-shaped flow path cross section. The first main flow paths 51 adjacent to each other in the front-rear direction and the left-right direction are independent of each other.

A partially enlarged view H2 shown in FIG. 6 shows an enlarged view at the middle upper-lower direction position H2 among the three enlarged views, and shows a middle part of the introduction side shape changing section 55. A flow path cross section at the upper-lower direction position H2 becomes wider as a length of a flow path extending in the front-rear direction becomes longer, and becomes narrower as a length of a flow path extending in the left-right direction becomes shorter from the cross-shaped flow path cross section (FIG. 5) at the upper-lower direction position H1 toward the introduction chamber 52 (upward). A communication path S is gradually provided between the first main flow paths 51 adjacent to each other in the front-rear direction. The flow path cross section at the upper-lower direction position H2 becomes wider as the length of the flow path extending in the front-rear direction becomes longer, and becomes narrower as the length of the flow path extending in the left-right direction becomes shorter further toward the introduction chamber 52 (upward).

Here, a cross-sectional area of the flow path cross section of the first main flow path 51 is the same in the introduction side shape changing section 55. That is, a flow path cross-sectional shape gradually changes in the introduction side shape changing section 55, but the cross-sectional area of the flow path cross section does not change. Therefore, the cooling water can flow more smoothly, and a pressure loss can be reduced.

A partially enlarged view H3 shown in FIG. 7 shows an enlarged view at the uppermost upper-lower direction position H3 among the three enlarged views, and shows an end point of the introduction side shape changing section 55. A flow path cross section at the upper-lower direction position H3 is connected to the adjacent first main flow path 51 and forms a straight line in the front-rear direction. That is, the communication path S cannot be distinguished from the flow path extending in the front-rear direction, and the flow path extending in the left-right direction disappears. The linear flow path shown in FIG. 7 communicates with the introduction chamber 52 located further above.

In this way, due to the introduction side shape changing section 55, the flow path cross section of the first main flow path 51 gradually changes and is linearly connected to the adjacent first main flow path 51, and communicates with the introduction chamber 52, so that a space having a predetermined width in the left-right direction and communicating with the plurality of second main flow paths 71 arranged in the front-rear direction extends in the front-rear direction between the introduction chambers 52 adjacent to each other in the left-right direction. Then, the air discharged from the second main flow path 71 of the second refrigerant flow path 7 is discharged to the outside from the discharge port 73 through this space, and does not hinder the flow of the air discharged from the second main flow path 71 of the second refrigerant flow path 7. Therefore, even if the introduction chamber 52 is disposed in a flow path space of the air from the discharge port 73 to the second main flow path 71, the flow of the air is not blocked.

Although the detailed description is omitted, similarly, the discharge side shape changing section 56 of the first main flow path 51 has the flow path cross-sectional shape gradually changing toward the discharge chamber 53 and is linearly connected to the adjacent first main flow path 51. In this way, due to the discharge side shape changing section 56, the flow path cross section of the first main flow path 51 gradually changes and is linearly connected to the adjacent first main flow path 51, and communicates with the discharge chamber 53, so that a space having a predetermined width in the left-right direction and communicating with the plurality of second main flow paths 71 arranged in the front-rear direction extends in the front-rear direction between the discharge chambers 53 adjacent to each other in the left-right direction. Then, the air introduced from the introduction port 72 is introduced into the second main flow path 71 of the second refrigerant flow path 7 through this space, and does not hinder the flow of the air introduced from the introduction port 72. Therefore, even if the discharge chamber 53 is disposed in a flow path space of the air from the introduction port 72 to the second main flow path 71, the flow of the air is not blocked.

In addition, in the introduction side shape changing section 55 and the discharge side shape changing section 56, by changing only the shape while maintaining the same cross-sectional area of the flow path cross section, it is possible to avoid an increase in the pressure loss of the cooling water flowing in the core portion 3.

Figure 9:
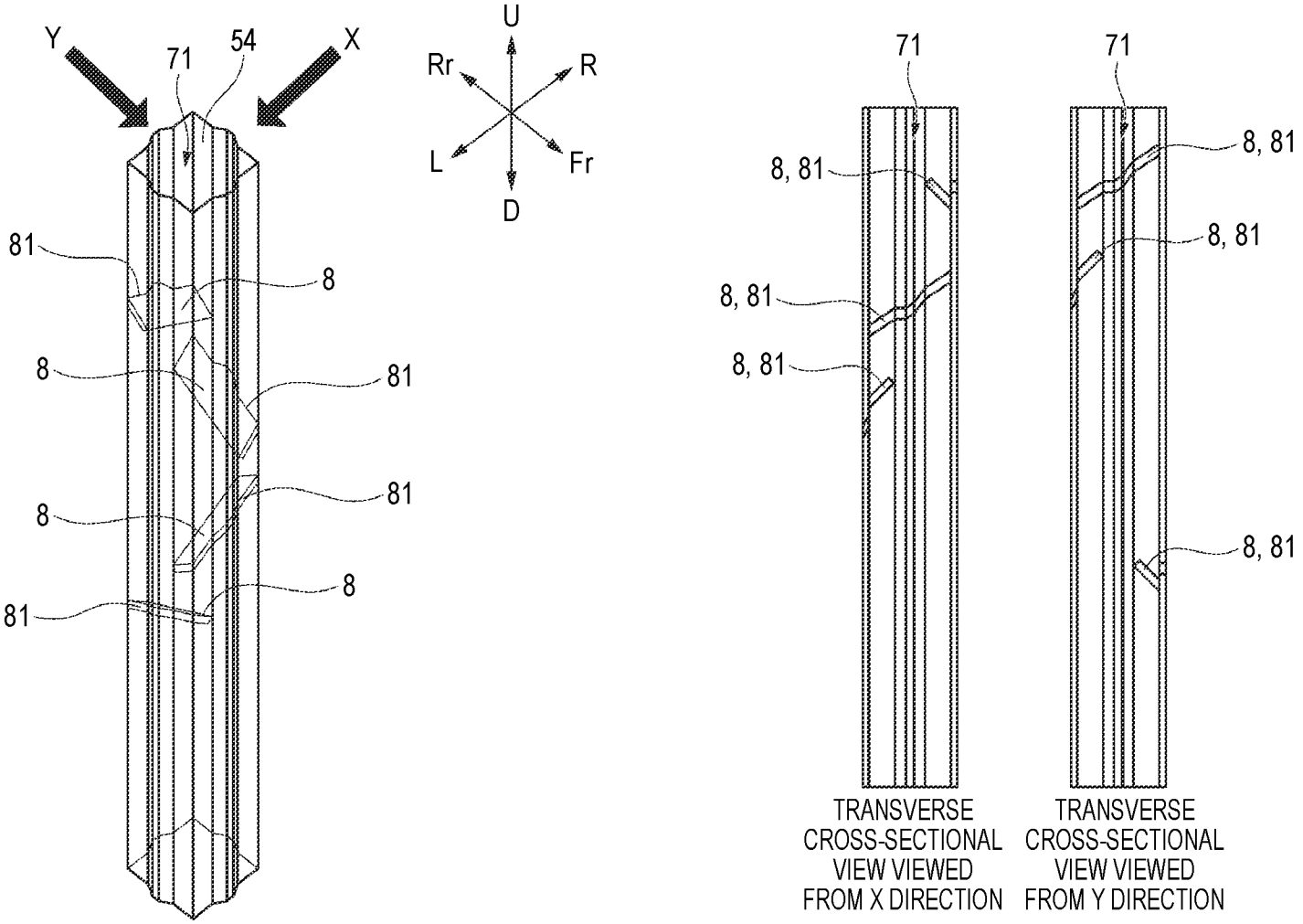
FIG. 9 is a transparent perspective view showing one second main flow path in the radiator 1 of FIG. 1.

As shown in FIGS. 3 and 9, in each of the second main flow paths 71, a plurality of fins 8 extending from the partition wall 54 toward a center of the second main flow path 71 when viewed from the upper-lower direction are spirally provided with the upper-lower direction as an axis at predetermined intervals in the upper-lower direction.

Due to the plurality of fins 8 provided in the second main flow path 71, a tornado-like vortex flow is generated along a flow direction in the flow of the air flowing through the second main flow path 71. Accordingly, the air flowing through the second main flow path 71 is stirred, so that heat exchange efficiency between the cooling water flowing through the first main flow path 51 and the air flowing through the second main flow path 71 via the partition wall 54 is improved.

The plurality of fins 8 are spirally provided at angular intervals of 30 degrees or more and 180 degrees or less in a circumferential direction with the upper-lower direction as an axis. The angular intervals of the plurality of fins 8 in the circumferential direction may be appropriately set based on a balance between a pressure loss and a degree of stirring of the air flowing through the second main flow path 71. FIGS. 3 and 9 show an example in which the plurality of fins 8 are spirally provided at intervals of 90 degrees in the circumferential direction with the upper-lower direction as an axis.

Accordingly, the flow of the air flowing through the second main flow path 71 is more likely to be the tornado-like vortex flow along the flow direction, and the heat exchange efficiency between the cooling water flowing through the first main flow path 51 and the air flowing through the second main flow path 71 via the partition wall 54 is further improved.

Each fin 8 is connected to the partition wall 54 by a base end portion 81. The base end portion 81 of the fin 8 is connected to the partition wall 54 along a spiral direction while being inclined at a predetermined angle with respect to a plane perpendicular to the upper-lower direction.

Accordingly, it is possible to stir the air flowing through the second main flow path 71 while preventing the increase in the pressure loss generated when the air flows through the second main flow path 71. Further, even when foreign matter is mixed into the second main flow path 71 together with the air, the foreign matter is prevented from being accumulated on the fin 8, and thus it is possible to stir the air flowing through the second main flow path 71 while preventing clogging of the second main flow path 71.

Further, in the fins 8 adjacent to each other in the upper-lower direction, a lower end of the upper fin 8 is located above an upper end of the lower fin.

Accordingly, it is possible to stir the air flowing through the second main flow path 71 while preventing the increase in the pressure loss when the air flows through the second main flow path 71. Further, even when the foreign matter is mixed into the second main flow path 71 together with the air, it is possible to stir the air flowing through the second main flow path 71 while preventing clogging of the foreign matter between the adjacent fins 8.

Figure 10:
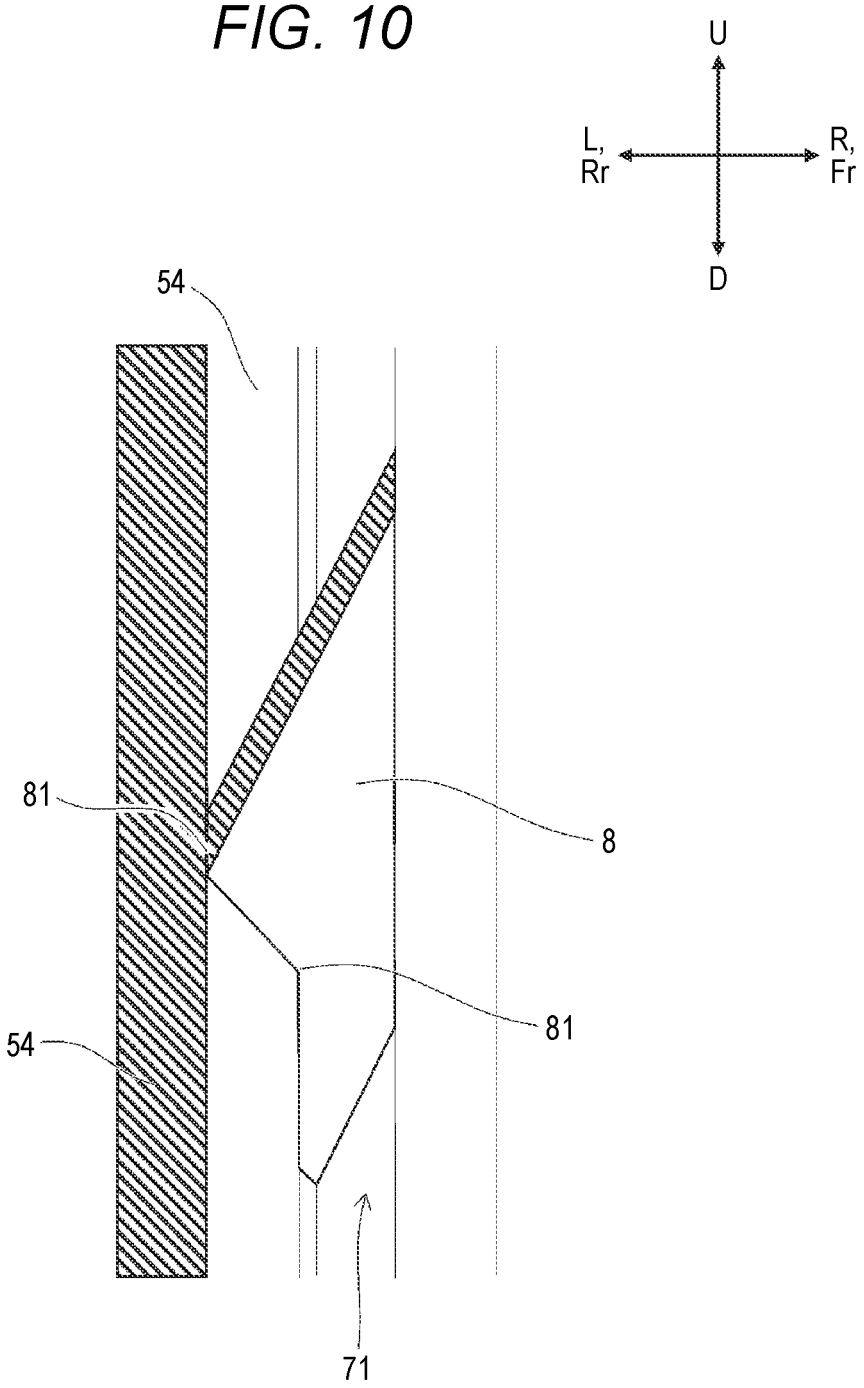
FIG. 10 is a partial cross-sectional view showing a part of a cross section taken along a line E-E in FIG. 3.

As shown in FIG. 10, the fin 8 extends from the base end portion 81 toward a center of the first main flow path 51 when viewed from the upper-lower direction while being inclined in the flow direction of the air (upward in the present embodiment) with respect to the plane perpendicular to the upper-lower direction.

Accordingly, it is possible to stir the air flowing through the second main flow path 71 while preventing the increase in the pressure loss when the air flows through the second main flow path 71. Further, even when the foreign matter is mixed into the second main flow path 71 together with the air, the foreign matter is prevented from being accumulated on the fin 8, and thus it is possible to stir the air flowing through the second main flow path 71 while preventing the clogging of the second main flow path 71.

Returning to FIG. 3, the second main flow path 71 has a through region 71*a* in which the fins 8 are not arranged when viewed from the upper-lower direction. In the present embodiment, when viewed from the upper-lower direction, a region including the center of the second main flow path 71 is the through region 71*a*.

Accordingly, it is possible to prevent the increase in the pressure loss when the air flows through the second main flow path 71. Further, even when the foreign matter is mixed into the second main flow path 71 together with the air, it is possible to further prevent clogging of the foreign matter in the second main flow path 71. In addition, a part of the air flowing through the through region 71*a* flows closer to the partition wall 54 by the fin 8, and thus the air flowing through the second main flow path 71 can be further stirred.

Figure 11:
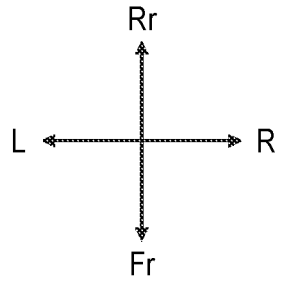
FIG. 11 is a partial cross-sectional view showing a part of a cross section taken along the line B-B in FIG. 1 in an example in which a plurality of fins 8 are spirally provided in a second main flow path 71 at intervals of 45 degrees in a circumferential direction with an upper-lower direction as an axis.
Figure 11:
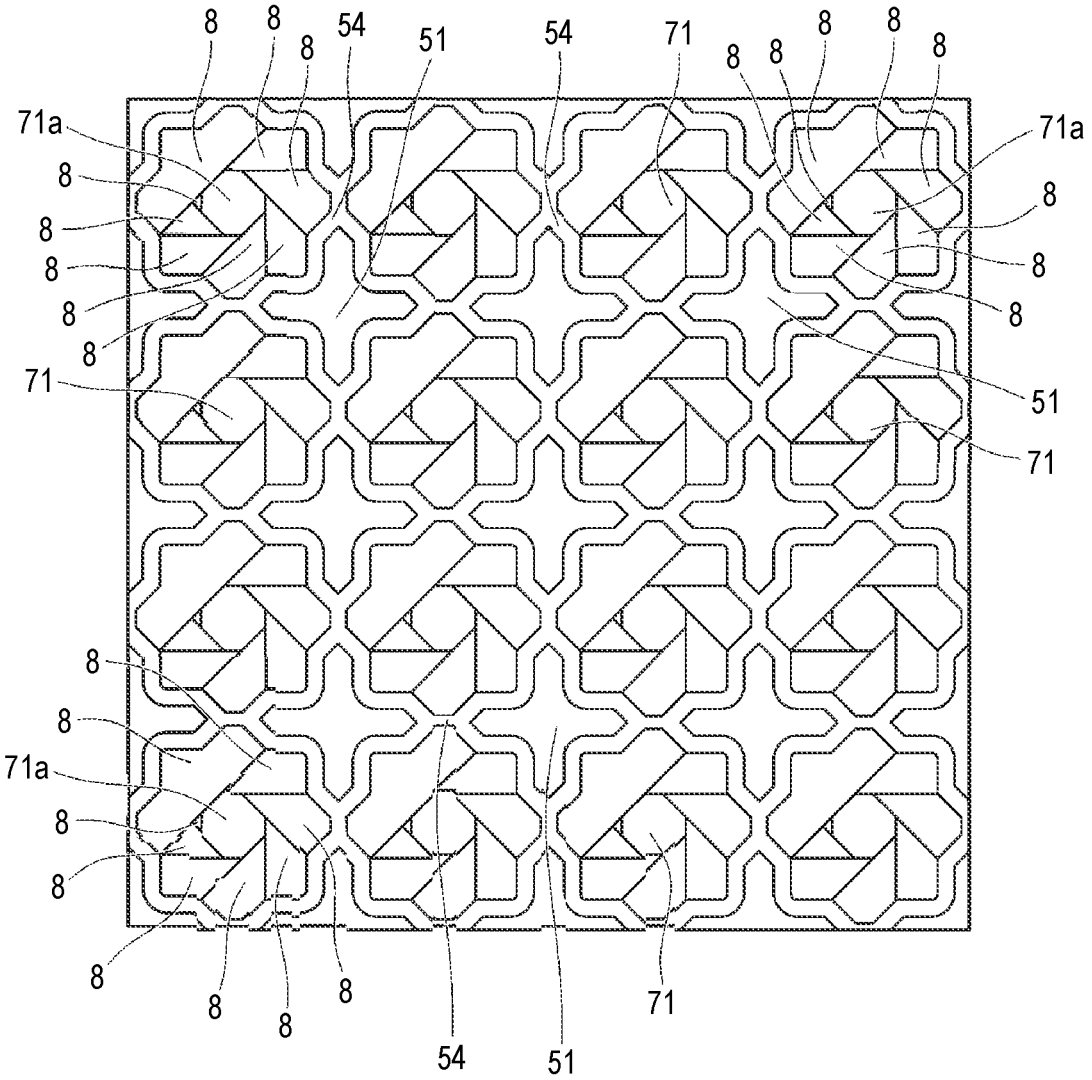

FIG. 11 shows another example in which the plurality of fins 8 are spirally provided in the second main flow path 71 at intervals of 45 degrees in the circumferential direction with the upper-lower direction as an axis. Although illustration is omitted, in the present example, the base end portion 81 of the fin 8 is similarly connected to the partition wall 54 along a spiral direction while being inclined at a predetermined angle with respect to the plane perpendicular to the upper-lower direction. Further, in the fins 8 adjacent to each other in the upper-lower direction, a lower end of the upper fin 8 is located above an upper end of the lower fin 8. The fin 8 extends from the base end portion 81 toward the center of the second main flow path 71 when viewed from the upper-lower direction while being inclined in the flow direction of the air (upward in the present embodiment) with respect to the plane perpendicular to the upper-lower direction. As shown in FIG. 11, the second main flow path 71 has a through region 71*a* in which the fins 8 are not arranged when viewed from the upper-lower direction. In the present embodiment, when viewed from the upper-lower direction, a region including the center of the second main flow path 71 is the through region 71*a*.

Although illustration is omitted, the plurality of fins 8 may be spirally provided in the second main flow path 71 at angular intervals of 30 degrees or more and 180 degrees or less in the circumferential direction with the upper-lower direction as an axis, and for example, may be spirally provided in the second main flow path 71 at intervals of 60 degrees in the circumferential direction, or may be spirally provided in the second main flow path 71 at intervals of 135 degrees in the circumferential direction.

In the radiator 1 according to the present embodiment, the core portion 3 is formed by additive manufacturing a material. More specifically, the core portion 3 including the first refrigerant flow path 5 and the second refrigerant flow path 7 that is provided with the fins 8 is integrally formed by additive manufacturing a material from the lower end surface of the core portion 3. An additive manufacturing method of forming a shape by additive manufacturing a material is one of methods of manufacturing a three-dimensional shape. The additive manufacturing method is a manufacturing method of forming a member having a three-dimensional shape by laminating, based on a three-dimensional model, layers of a material corresponding to continuous cross sections of the three-dimensional model one by one. The additive manufacturing method is also known as a 3D printing technique. Unlike the conventional cutting process of forming a final product by performing cutting on a material block, the final product is formed by laminating a material in the additive manufacturing method, making it possible to form a complicated three-dimensional shape. The additive manufacturing method is also called an additive fabrication method, additive manufacturing, or an additive manufacturing (AM) technique.

In the additive manufacturing method, metal, ceramic, resin, or the like can be used as a material to be laminated. In the present embodiment, the core portion 3 is formed of metal. The core portion 3 may be formed of ceramic, resin, or the like.

By forming the core portion 3 by additive manufacturing a material, even when the second refrigerant flow path 7 provided with the fins 8 has a complicated shape, it is easy to integrally form the core portion 3 including the first refrigerant flow path 5 and the second refrigerant flow path 7 that is provided with the fins 8.

The fin 8 extends from the base end portion 81 while being inclined in the flow direction of the air (upward in the present embodiment) with respect to the plane perpendicular to the upper-lower direction, and thus by additive manufacturing a material along the flow direction of the air in the second main flow path 71 (that is, from the lower end surface to the upper end surface in the present embodiment), the fin 8 can be integrally formed with the partition wall 54 without forming a support.

At this time, in the fin 8, an angle formed by the partition wall 54 and the fin 8 in the base end portion 81 is within 75 degrees, and more preferably within 45 degrees (see FIG. 10). Accordingly, at the time of additive manufacturing a material, the fin 8 can be more easily formed integrally with the partition wall 54 without forming a support.

Not only the core portion 3, but also the introduction pipe 11 and the discharge pipe 13 may be integrally manufactured with the core portion 3 by the additive manufacturing method. When the core portion 3, the introduction pipe 11, and the discharge pipe 13 are manufactured separately, a process of assembling the introduction pipe 11 and the discharge pipe 13 to the core portion 3 is required, but this process can be omitted by integral manufacturing using the additive manufacturing method. A predetermined powder material may be resin or metal.

Although an embodiment of the present invention has been described above with reference to the accompanying drawings, it is needless to say that the present invention is not limited to the embodiment. It is apparent that those skilled in the art can conceive of various modifications and alterations within the scope described in the claims, and it is understood that such modifications and alterations naturally fall within the technical scope of the present invention. In addition, components in the above embodiment may be freely combined without departing from the gist of the invention.

For example, in the above embodiment, the radiator 1 including the core portion 3 having a box-like shape has been shown as an example, but the core portion 3 may have a complicated shape that is three-dimensionally curved by the additive manufacturing method.

For example, the plurality of fins 8 may not be spirally provided in the second main flow path 71 at regular intervals in the circumferential direction with the upper-lower direction as an axis, and may be spirally provided in the second main flow path 71 at predetermined irregular intervals in the circumferential direction.

For example, the plurality of fins 8 may have a flat plate shape, a curved plate shape, or any three-dimensional shape.

In the present specification, at least the following matters are described. In parentheses, corresponding components and the like in the above embodiment are shown as an example, but the present invention is not limited thereto.

(1) A heat exchanger (radiator 1), including:
- a core portion (core portion 3);
- a first refrigerant flow path (first refrigerant flow path 5) provided in the core portion and configured to allow a first fluid (cooling water) to flow therethrough; and
- a second refrigerant flow path (second refrigerant flow path 7) provided in the core portion and configured to allow a second fluid (air) to flow therethrough, in which
- in the core portion, the first fluid flowing through the first refrigerant flow path and the second fluid flowing through the second refrigerant flow path exchange heat,
- the first refrigerant flow path includes a first main flow path (first main flow path 51) extending in a first direction (upper-lower direction),
- the second refrigerant flow path includes a second main flow path (second main flow path 71) extending in the first direction,
- the first main flow path and the second main flow path are defined by a partition wall (partition wall 54) extending in the first direction in the core portion,
- the second fluid flows through the second main flow path from one side (lower side) to the other side (upper side) in the first direction, and
- in the second main flow path, a plurality of fins (fins 8) extending from the partition wall toward a center of the second main flow path when viewed from the first direction are spirally provided with the first direction as an axis at predetermined intervals in the first direction.

According to (1), due to the plurality of fins provided in the second main flow path, a tornado-like vortex flow is generated along a flow direction in the second fluid flowing through the second main flow path. Accordingly, the first fluid flowing through the second main flow path is stirred, so that heat exchange efficiency between the first fluid flowing through the first main flow path and the second fluid flowing through the second main flow path via the partition wall is improved.

(2) The heat exchanger according to (1), in which
- the plurality of fins are spirally provided at angular intervals of 30 degrees or more and 180 degrees or less in a circumferential direction with the first direction as an axis when viewed from the first direction.

According to (2), the flow of the second fluid flowing through the second main flow path is more likely to be the tornado-like vortex flow along the flow direction, and the heat exchange efficiency between the first fluid flowing through the first main flow path and the second fluid flowing through the second main flow path via the partition wall is further improved.

(3) The heat exchanger according to (1), in which
- the fin includes a base end portion (base end portion 81) connected to the partition wall, and
- the base end portion is connected to the partition wall along a spiral direction of the plurality of fins while being inclined at a predetermined angle with respect to a plane perpendicular to the first direction.

According to (3), it is possible to stir the second fluid flowing through the second main flow path while preventing an increase in a pressure loss generated when the second fluid flows through the second main flow path. Further, even when foreign matter is mixed into the second main flow path together with the second fluid, the foreign matter is prevented from being accumulated on the fin, and thus it is possible to stir the second fluid flowing through the second main flow path while preventing clogging of the second main flow path.

(4) The heat exchanger according to (3), in which
in the fins adjacent to each other in the first direction, an end on the one side in the first direction of the fin located on the other side in the first direction is located on the other side in the first direction with respect to an end on the other side in the first direction of the fin located on the one side in the first direction.

According to (4), it is possible to stir the second fluid flowing through the second main flow path while preventing the increase in the pressure loss generated when the second fluid flows through the second main flow path. Further, even when the foreign matter is mixed into the second main flow path together with the second fluid, it is possible to stir the second fluid flowing through the second main flow path while preventing clogging of the foreign matter between the adjacent fins.

(5) The heat exchanger according to (1), in which
the fin includes a base end portion (base end portion 81) connected to the partition wall, and extends from the base end portion toward a center of the second main flow path when viewed from the first direction while being inclined toward the other side in the first direction with respect to a plane perpendicular to the first direction.

According to (5), it is possible to stir the second fluid flowing through the second main flow path while preventing the increase in the pressure loss generated when the second fluid flows through the second main flow path. Further, even when the foreign matter is mixed into the second main flow path together with the second fluid, the foreign matter is prevented from being accumulated on the fin, and thus it is possible to stir the second fluid flowing through the second main flow path while preventing the clogging of the second main flow path.

(6) The heat exchanger according to (1), in which
the second main flow path has a through region (through region 71*a*) in which the fins are not arranged when viewed from the first direction.

According to (6), it is possible to prevent the increase in the pressure loss generated when the second fluid flows through the second main flow path. Further, even when the foreign matter is mixed into the second main flow path together with the second fluid, it is possible to further prevent clogging of the foreign matter in the second main flow path. In addition, a part of the second fluid flowing through the through region flows closer to the partition wall by the fin, and thus the second fluid flowing through the second main flow path can be further stirred.

(7) A method for manufacturing the heat exchanger according to (1), the method including:
integrally forming the core portion including the first refrigerant flow path and the second refrigerant flow path that is provided with the fins by additive manufacturing a material.

According to (7), by forming the core portion by additive manufacturing a material, even when the second refrigerant flow path provided with the fins has a complicated shape, it is easy to integrally form the core portion including the first refrigerant flow path and the second refrigerant flow path that is provided with the fins.

REFERENCE SIGNS LIST

1: radiator (heat exchanger)
3: core portion
5: first refrigerant flow path
51: first main flow path
54: partition wall
7: second refrigerant flow path
71: second main flow path
71*a*: through region
8: fin
81: base end portion

What is claimed is:

1. A heat exchanger comprising:
a core portion;
a first refrigerant flow path provided in the core portion and configured to allow a first fluid to flow therethrough; and
a second refrigerant flow path provided in the core portion and configured to allow a second fluid to flow therethrough, wherein
in the core portion, the first fluid flowing through the first refrigerant flow path and the second fluid flowing through the second refrigerant flow path exchange heat with each other,
the first refrigerant flow path comprises a first main flow path extending in a first direction,
the second refrigerant flow path comprises a second main flow path extending in the first direction,
the first main flow path and the second main flow path are defined by a partition wall extending in the first direction in the core portion,
the second fluid flows through the second main flow path from one side to an other side in the first direction,
in the second main flow path, a plurality of fins extending from the partition wall toward a center of the second main flow path when viewed from the first direction are spirally provided with the first direction as an axis at predetermined intervals in the first direction,
the plurality of fins comprise at least three fins disposed at different positions along the central axis of the second main flow path,
the plurality of fins are disposed without crossing the central axis of the second main flow path,
each of the plurality of fins comprises a base end portion connected to the partition wall, and
the base end portion is connected to the partition wall along a spiral direction of the plurality of fins while being inclined at a predetermined angle with respect to a virtual plane perpendicular to the first direction.

2. The heat exchanger according to claim 1, wherein
the plurality of fins are spirally provided at angular intervals of 30 degrees or more and 180 degrees or less in a circumferential direction with the first direction as an axis when viewed from the first direction.

3. The heat exchanger according to claim 1, wherein
in two of the plurality of fins adjacent to each other in the first direction, an end, on the one side in the first direction, of the fin located on the other side in the first direction is located on the other side in the first direction with respect to an end, on the other side in the first direction, of the fin located on the one side in the first direction.

4. The heat exchanger according to claim 1, wherein each of the plurality of fins extends from the base end portion toward a center of the second main flow path when viewed from the first direction while being inclined toward the other side in the first direction with respect to a virtual plane perpendicular to the first direction.

5. The heat exchanger according to claim 1, wherein the second main flow path has a through region in which the plurality of fins are not arranged when viewed from the first direction.

6. The heat exchanger according to claim 1, wherein an end, located most on the other side in the first direction, of the base end portion of one, at the one side, of two adjacent fins among the plurality of fins, and an end, located most on the one side in the first direction, of the base end portion of an other, at the other side, of the two adjacent fins are located at positions overlapping each other when viewed in the first direction.

7. A heat exchanger comprising:

a core portion;

a first refrigerant flow path provided in the core portion and configured to allow a first fluid to flow therethrough; and a second refrigerant flow path provided in the core portion and configured to allow a second fluid to flow therethrough, wherein in the core portion, the first fluid flowing through the first refrigerant flow path and the second fluid flowing through the second refrigerant flow path exchange heat with each other, the first refrigerant flow path comprises a first main flow path extending in a first direction, the second refrigerant flow path comprises a second main flow path extending in the first direction, the first main flow path and the second main flow path are defined by a partition wall extending in the first direction in the core portion, the second fluid flows through the second main flow path from one side to an other side in the first direction, in the second main flow path, a plurality of fins extending from the partition wall toward a center of the second main flow path when viewed from the first direction are spirally provided with the first direction as an axis at predetermined intervals in the first direction, the plurality of fins are disposed without crossing the central axis of the second main flow path, each of the plurality of fins comprises a base end portion connected to the partition wall, and the base end portion is connected to the partition wall along a spiral direction of the plurality of fins while being inclined at a predetermined angle with respect to a virtual plane perpendicular to the first direction.

* * * * *